US005527009A

United States Patent [19]

Allen

[11] Patent Number: 5,527,009

[45] **Date of Patent: *Jun. 18, 1996**

[54] WALL-MOUNTED BUCKET POURER

[76] Inventor: Donald K. Allen, Rte. 4, Box 352, Four Oaks, N.C. 27524

[ * ] Notice: The term of this patent shall not extend beyond the expiration date of Pat. No. 5,316,428.

[21] Appl. No.: 296,431

[22] Filed: Aug. 26, 1994

[51] Int. Cl.[6] ..... A47F 5/12

[52] U.S. Cl. ..... 248/311.3; 248/137; 248/141

[58] Field of Search ..... 248/137, 139, 248/140, 142, 291, 311.2, 311.3, 141; 211/88, 99

[56] References Cited

U.S. PATENT DOCUMENTS

| | | | |
|---|---|---|---|
| 989,104 | 4/1911 | Anderson | 248/141 |
| 1,197,012 | 9/1916 | Conlin | 248/141 X |
| 1,313,340 | 8/1919 | Sell | 248/139 |
| 1,446,699 | 2/1923 | Goble et al. | 248/142 |
| 1,807,589 | 6/1931 | Edmunds | 211/88 X |
| 2,554,875 | 5/1951 | Okunami | 248/141 |
| 2,614,700 | 10/1952 | Kjeldsen | 248/311.3 X |
| 2,682,339 | 6/1954 | Ferris | 248/311.3 X |
| 2,917,184 | 12/1959 | Beall, Jr. | 248/311.3 X |
| 4,317,551 | 3/1982 | Bishop | 248/141 |
| 5,316,248 | 5/1994 | Allen | 248/137 X |

FOREIGN PATENT DOCUMENTS

| | | | |
|---|---|---|---|
| 2402771 | 7/1975 | Germany | 248/137 |

*Primary Examiner*—Ramon O. Ramirez
*Assistant Examiner*—Derek J. Berger
*Attorney, Agent, or Firm*—Rhodes, Coats & Bennett

[57] ABSTRACT

The present invention entails a wall-mounted bucket holder and pourer. The wall-mounted bucket holder and pourer includes a wall frame structure that is designed to be mounted to the side of a wall. Pivotally mounted in the wall mounting frame structure is a bucket holder and pourer that is pivotable from an upright position to an inclined pouring position.

8 Claims, 1 Drawing Sheet

WALL-MOUNTED BUCKET POURER

FIELD OF INVENTION

The present invention relates to devices and structures utilized to hold a bucket and to tilt the same bucket for purposes of pouring. More particularly, the present invention relates to a bucket holder and pourer that is mounted and supported within a wall frame structure which is in turn adapted to be mounted to a wall.

BACKGROUND OF THE INVENTION

It is known in the prior art to provide a structure for holding a bucket and tilting the bucket to pour material or a liquid therefrom. For example, see the disclosures found in the following U.S. Patents: U.S. Pat. No. 978,562; U.S. Pat. Nos. 2,937,836; and 3,236,483.

In my recently issued U.S. Patent, U.S. Pat. No. 5,316,248 I disclosed a portable bucket holder and pourer for holding a bucket and pivoting the bucket to a tilted position for purposes of pouring material from the bucket. Herein, I disclosed a floor station or floor mounted structure that is designed to hold a bucket and to move the bucket from an upright position to a tilted position where materials such as a liquid can be poured from the bucket.

One major drawback and disadvantage to a floor mounted bucket pourer is that such devices tend to consume a great deal of space and form obstacles in the work area. Because of this inconvenience, conventional bucket, holder designs do not lend themselves to all types of work areas.

There is a need for a device for holding and tilting a bucket that is compact and which can be disposed about the periphery of a working area where the device itself does not disrupt traffic and work flow within the work area.

SUMMARY AND OBJECTS OF THE PRESENT INVENTION

The present invention entails a wall-mounted bucket holder and pourer assembly. Forming a part of the wall-mounted bucket holder and pourer assembly is a wall structure that is designed to be mounted directly to a wall. Pivotally mounted within that wall structure is a bucket holder and pourer that can be rotated from a vertical or upright position to a tilted pouring position.

It is therefore an object of the present invention to provide a device for holding a bucket and for tilting the bucket from an upright position to a tilted pouring position wherein the device is designed to be mounted to a wall and consequently is free of floor support.

A further object of the present invention is to provide a bucket holder and pourer that is of a wall-mounted design and which is of a relatively simple, sturdy and economical design.

Another object of the present invention is to provide a wall-mounted bucket holder and pourer of the character described above that is easy to use and which is durable.

Other objects and advantages of the present invention will become apparent and obvious from a study of the following description and the accompanying drawings which are merely illustrative of such invention.

DETAILED DESCRIPTION OF THE INVENTION

Figure 1:
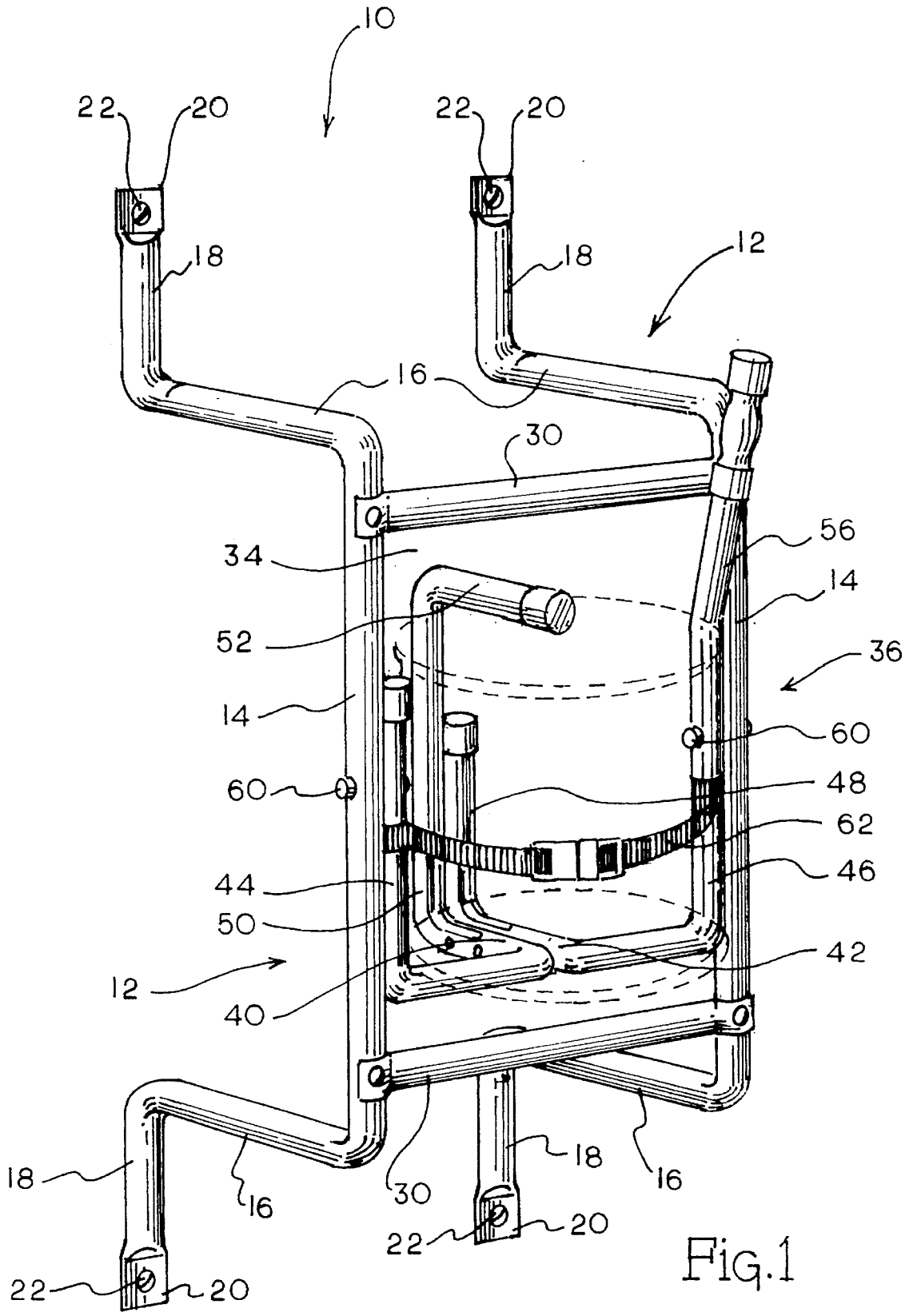
FIG. 1 is a perspective view of the wall-mounted bucket holder and pourer of the present invention.

With further reference to the drawings, the wall-mounted bucket holder and pourer of the present invention is shown therein and indicated generally by the numeral 10. As will be appreciated from subsequent portions of this disclosure, the bucket holder and pourer disclosed herein is specifically designed to be mounted to and supported on a wall.

First, reviewing the wall mounting frame, it is seen that the wall mounting frame includes two generally U-shaped side frames with each side frame being indicated generally by the numeral 12. Viewing each side frame it is seen that the same includes a vertical member 14 having opposed opposite end portions. Mounted to each end portion of the vertical member 14 is a horizontal member 16 that projects generally rearwardly (toward the wall) from the vertical member 14 and forms a right angle with the vertical member 14. Each horizontal member 16 includes a rear end portion that is spaced from the vertical member 14. Extending from the rear end portion of each horizontal member 16 is a wall strut or run 18 that is designed to fit flush against the wall. The remote end of each wall strut 18 includes a stamped or crimped end 20 that has formed therein a hole 22 through which a securing screw or the like can be extended.

To secure the two generally U-shaped side frames 12 together, there is provided upper and lower cross-members 30 and 32 respectively, that extend between and secure the U-shaped side frames 12 together. Defined between the upper and lower cross-members 30 and 32 and the U-shaped frames 12 is an open area 34 that is of a sufficient size to allow a bucket holder and pourer assembly to move or rotate therethrough.

Secured to the wall mounting frame structure just described is a bucket holder and pourer assembly indicated generally by the numeral 36. The bucket holder and pourer 36 is designed to receive and hold a bucket (shown in dotted lines in FIG. 1), such as five-gallon bucket, and can be moved from an upright stationary position to a tilted pouring position.

Viewing the structure of the bucket holder and pourer 36, it is seen that the same is of an open frame construction which is very practical and economical. Structurally, the holder and pourer includes a T-shaped bottom, an open side wall frame, and a top retainer. Viewing the structure of the holder and pourer in more detail, the T-shaped bottom includes a base portion 40 and a cross piece 42. It is seen that the base portion 40 is formed by two pipes that extend in side-by-side relationship from the cross piece 42 to a rear point or portion of the bottom.

The open side frame structure is comprised of a series of upstanding posts that are designed to extend upwardly adjacent a side wall portion of a bucket that shown in dotted lines. More particularly, there is provided a pair of upstanding pivot posts 44 and 46 that extend upwardly from opposed end portions of the cross piece 42. It is appreciated that the upstanding pivot posts 44 and 46 tend to retain the bucket about opposed sides of the bucket holder and pourer 36.

Formed about the rear of the bucket holder and pourer 36 is a pair of back posts 48 and 50. It will be appreciated that the back posts 48 and 50 are of different relative heights. That is, one of the back posts is taller than the other. This is because there is provided a top retainer 52 that is designed to be secured within either of the back posts 48 or 50. As seen in the drawings, the top retainer 52 is of an L-shape or bent pipe design that extends up adjacent the back side of the bucket and then turns and extends over the top of the same. By selectively placing the top retainer 52 into either of the back posts 48 or 50, the effective height of the top retainer 52 can be adjusted between two positions. This enables the top retainer 52 to act on buckets of two different heights. For a more complete and unified understanding of this principle, one is referred to the disclosure in U.S. Pat. No. 5,316,248 and particularly FIG. 6 therein. The disclosure of U.S. Pat. No. 5,316,248 is expressly incorporated herein by reference.

A handle 56 forms a part of the bucket holder and pourer and is secured to or integrally formed with one of the pivot posts 44 or 46. Thus, as seen in the drawings, the handle 56 extends upwardly from one of the pivot posts 44 or 46. In an upright position as illustrated in FIG. 1, the bucket holder and pourer 36 is maintained in that position by the engagement of the handle 56 with a part of the frame structure of the wall-mounted bucket holder and pourer 10. Note in FIG. 1 that due to the design of the structure, that the weight of the bucket causes the handle 56 to be rotated into contact with the supporting frame structure. Again, this effectively stops and holds the bucket pourer in a stopped upright position.

To support the bucket holder and pourer 36 within the frame structure of the present invention, there is provided a pair of pivots or pivot pins 60 that extend through the vertical members 16 of the U-shaped side frames and through the pivot posts 44 and 46. Consequently, pivot posts 44 and 46 pivot back and forth about the axis of the pivot pin 60.

Finally, the bucket holder and pourer 36 is provided with a flexible belt or strap 62 that is designed to extend around the front of the bucket holder and pourer so as to secure the bucket within the frame structure of the holder and pourer.

From the foregoing specification and discussion, it is appreciated that the present invention presents a wall-mounted bucket holder and pourer that is compact and which can be mounted directly to a wall. This alleviates the inconvenience that is associated with structures that are floor supported and which are typically disposed in and around a work area.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended Claims are intended to be embraced therein.

What is claimed is:

1. A wall-mounted bucket holder and pourer comprising: a wall frame including a pair of laterally spaced generally U-shaped side frames; each side frame including a vertical member having opposite end portions, upper and lower horizontal members projecting from opposite end portions of the vertical member, and a pair of wall runs connected to the horizontal members and extending generally parallel with the vertical member; a pair of vertically spaced transversely extending cross-members interconnecting the two side frames and defining an open space therebetween; a bucket holder and pourer disposed between the two side frames and between the two cross-members; the bucket holder and pourer including a bottom, a side frame structure and a top retainer for engaging the top of a bucket; a pair of pivots for securing the bucket holder and pourer to the U-shaped side frames, each pivot connected to the vertical member of a respective U-shaped side frame and extending therefrom inwardly for pivotable connection with the side frame of the bucket holder and pourer such that the bucket holder and pourer may be pivoted about the pivots from an upright position to a tilted pouring position; and a handle extending from the bucket holder and pourer.

2. The wall-mounted bucket holder and pourer of claim 1 wherein the handle extends at least slightly forward sufficient to extend on a forward side of at least one of the cross-members and actually engages that cross-member when the bucket holder and pourer is disposed in the upright position.

3. The wall-mounted bucket holder and pourer of claim 1 wherein the bottom of the bucket holder and pourer includes an open T-shaped frame configuration.

4. The wall-mounted bucket holder and pourer of claim 3 wherein the side frame structure of the bucket holder and pourer includes a series of upstanding post-type members that are spaced so as to extend vertically adjacent the side wall that forms a part of a bucket held by the bucket holder and pourer.

5. The wall-mounted bucket holder and pourer of claim 1 wherein the bucket holder and pourer includes a flexible strap secured thereto for securing a bucket within the confines of the bucket holder and pourer.

6. A wall-mounted bucket holder and pourer comprising: a wall frame including a pair of laterally spaced generally U-shaped side frames; each side frame including a vertical member having opposite end portions, and upper and lower horizontal members; a pair of vertically spaced transversely extending cross-members interconnecting the two side frames and defining an open space therebetween; a bucket holder and pourer disposed between the two side frames and between the two cross-members; the bucket holder and pourer including a T-shaped bottom including a base member and a cross piece that extends across the base member, two laterally spaced pivot posts extending upwardly from the cross piece of the T-shaped bottom, a back frame extending from the base member of the T-shaped bottom, a top retainer secured to the back frame and extending upwardly therefrom and having a curved top portion that extends over the T-shaped bottom and wherein there is a bucket space defined between the top retainer and the T-shaped bottom; a pair of pivots for securing the bucket holder and pourer to the side frames, each pivot connected to the vertical member of a respective side frame and extending therefrom inwardly for pivotable connection with the pivot posts of the bucket holder and pourer such that the bucket holder and pourer may be pivoted about the pivots from an upright position to a tilted pouring position; and a handle extending from the bucket holder and pourer.

7. The wall-mounted bucket holder of claim 6 wherein the handle projects forwardly from the bucket holder and pourer and is designed to engage a portion of the wall-mounted bucket holder and pourer for holding the bucket holder in an upright position.

8. The wall-mounted bucket holder and pourer of claim 6 wherein each side frame further includes a pair of wall runs connected to the horizontal members and extending generally parallel with the vertical member of the same side frame and wherein the wall runs fit flush against a wall and are secured directly to the wall.

* * * * *